US007299741B2

(12) United States Patent
Hiramatsu et al.

(10) Patent No.: US 7,299,741 B2
(45) Date of Patent: Nov. 27, 2007

(54) HYDRAULIC PRESSURE ACTUATOR AND CONTINUOUS MANUAL ATHLETIC DEVICE USING THE SAME

(75) Inventors: Kazuaki Hiramatsu, Tokyo (JP); Makoto Konami, Abiko (JP); Yutaka Satoh, Chiba (JP); Taisuke Matsushita, Abiko (JP); Shigekazu Suzuki, Kashiwa (JP); Katsuhiro Kuroda, Hachioji (JP); Kazuo Ooki, Yokohama (JP); Akibiko Toda, Chigasaki (JP)

(73) Assignee: Hitachi Medical Corporation, Tokyo (JP)

( * ) Notice: Subject to any disclaimer, the term of this patent is extended or adjusted under 35 U.S.C. 154(b) by 143 days.

(21) Appl. No.: 10/550,615

(22) PCT Filed: Mar. 12, 2004

(86) PCT No.: PCT/JP2004/003270

§ 371 (c)(1),
(2), (4) Date: Sep. 26, 2005

(87) PCT Pub. No.: WO2004/085856

PCT Pub. Date: Oct. 7, 2004

(65) Prior Publication Data

US 2006/0249017 A1 Nov. 9, 2006

(30) Foreign Application Priority Data

Mar. 25, 2003 (JP) ..... 2003-083648
Apr. 22, 2003 (JP) ..... 2003-117303

(51) Int. Cl.
*F01B 19/04* (2006.01)
*A61H 1/00* (2006.01)

(52) U.S. Cl. ..... 92/92; 601/5

(58) Field of Classification Search ..... 92/91, 92/92, 89, 90; 601/5; 901/22
See application file for complete search history.

(56) References Cited

U.S. PATENT DOCUMENTS 4,615,260 A * 10/1986 Takagi et al. ..... 92/92
4,733,603 A 3/1988 Kukolj
4,751,869 A * 6/1988 Paynter ..... 92/92
5,662,693 A * 9/1997 Johnson et al. ..... 607/49

FOREIGN PATENT DOCUMENTS

| | | |
|---|---|---|
| JP | 60-132103 | 7/1985 |
| JP | 60-139904 | 7/1985 |
| JP | 5-88523 | 4/1993 |
| JP | 7-204233 | 8/1995 |
| WO | WO 01/68028 A2 | 9/2001 |

* cited by examiner

*Primary Examiner*—Michael Leslie
(74) *Attorney, Agent, or Firm*—Antonelli, Terry, Stout & Kraus, LLP.

(57) ABSTRACT

A hydraulic pressure actuator having an inner tube and a mesh sleeve covering the outer periphery of the inner tube and longitudinally extendable by pressure fluid fed into the inner tube, wherein a low friction body formed in an elastic cylindrical body by knitting fine fibers in a circumferential direction without a seam is disposed between the inner tube and the mesh sleeve, and the low friction body contributes to an increase in the life of the hydraulic pressure actuator repeatedly performing extension/retraction motions. The hydraulic pressure actuator is used as an actuator for driving a CPM device which supports the extremity of a human body by ay least one of a plurality of members combined with each other and performs the rehabilitation of the joints of a handicapped by operating the member.

23 Claims, 13 Drawing Sheets

HYDRAULIC PRESSURE ACTUATOR AND CONTINUOUS MANUAL ATHLETIC DEVICE USING THE SAME

TECHNICAL FIELD

The present invention relates to a fluid pressure actuator driven by the feed/discharge of a fluid such as the air and a continuous passive motion (hereinafter abbreviated as CPM) device.

BACKGROUND ART

As a fluid pressure actuator, there has been known the one obtained by covering the outer periphery of a rubber tube (inner tube) with a mesh-like covering material (mesh sleeve) made of a resin without expanding/contracting property. The diameter of the mesh sleeve increases when the inner tube is expanded by feeding the air into the inner tube of the fluid pressure actuator. An increase in the diameter of the mesh sleeve is converted into a decrease in the length of the actuator since the material of the mesh sleeve has no expanding/contracting property. A contracting force (driving force) is obtained accompanying the decrease in the length of the actuator.

The fluid pressure actuator constituted chiefly by the elements of the mesh sleeve made of a resin and the inner tube made of rubber has a feature in that it is much lighter than the air cylinder equipped with a metallic cylinder and a rod. It is, therefore, expected that the fluid pressure actuator can be applied in a wide field of technology where the above-mentioned feature is required.

As the use of the fluid pressure actuator, there can be exemplified an artificial muscle or rehabilitation equipment for physically handicapped persons. Among them, the rehabilitation equipment for the physically handicapped persons may be the ones for the joints of the upper and lower limbs that have withered after the therapy for extended periods of time.

The conventional rehabilitation equipment for the joints, for example, the rehabilitation equipment disclosed in, for example, JP-A-2000-051297 is using an actuator such as a motor. However, since the motor is incorporated as a drive source in the equipment, the rehabilitation equipment becomes bulky and heavy. This involves a problem from such a standpoint that the handicapped person must carry and operate the rehabilitation equipment. It has, therefore, been desired to apply an air pressure actuator to the rehabilitation equipment for the physically handicapped persons.

As a result of experiment conducted by the present inventors, however, it was learned that when the above conventional fluid pressure actuator is repetitively expanded and contracted, for example, several hundreds of times, the inner tube expanded by the fluid (air) that is supplied partly swells through the mesh of the mesh sleeve often causing the inner tube to be damaged. Further, when the above fluid pressure actuator is repetitively used, the inner tube is often damaged or the mesh-like fiber of the mesh sleeve is broken.

U.S. Pat. No. 4,733,603 (hereinafter referred to as prior art document 1) and JP-A-61-236905 (hereinafter referred to as prior art document 2) are disclosing technical ideas for preventing the breakage of the fluid pressure actuator and for elongating the service life thereof. In order to decrease the friction between the inner tube and the mesh sleeve in the fluid pressure actuator, the prior art literature 1 discloses an art for forming a mesh sleeve by burying a mesh-like covering material in a layer of a soft material having expanding property and by providing a perforated friction-lowering layer between the inner tube and the laminar mesh sleeve. The above prior document discloses that the friction-lowering layer decreases the resistance at the time of expansion produced by the friction between the tube and the laminar mesh sleeve.

According to the fluid pressure actuator disclosed in the above prior document, however, the mesh sleeve must be produced by burying the mesh-like material in the layer of the soft material and, besides, the inner tube must be covered with a perforated friction-lowering layer leaving problems that must be solved, such as complex structure and increased cost.

The prior art document 2 is disclosing the art in which the mesh sleeve is covered with a rubbery elastic covering member which is introduced into gaps of mesh of the mesh sleeve.

According to the art disclosed in the above prior art document 2, however, a parting agent is simply applied between the mesh sleeve constituted as described above and the inner tube. It is therefore presumed that the inner tube is broken within short periods of time due to the friction between the inner tube and the mesh sleeve leaving a problem that must be solved, i.e., extend the service life of the fluid pressure actuator.

It is a first object of the present invention to provide a fluid pressure actuator which is simple in the structure and has a long operation life.

It is a second object of the present invention to provide a CPM device using the fluid pressure actuator of the present invention, i.e., to provide a CPM device for rehabilitation for the physically handicapped persons suffering from acquired disorder in the limbs or in some of the limbs.

DISCLOSURE OF THE INVENTION

In order to achieve the above first object, the fluid pressure actuator of the present invention comprises an inner tube that expands and contracts as the fluid is fed and discharged, a mesh sleeve covering the outer periphery of the inner tube, and a low friction member obtained by so knitting fine fibers as to possess expanding and contracting properties between the inner tube and the mesh sleeve, the low friction member being so arranged as to cover the inner tube.

The low friction member has a feature in that the coefficient of friction thereof for the mesh sleeve is smaller than the coefficient of friction thereof for the inner tube.

Desirably, the friction member is obtained in a cylindrical form without seam by knitting a synthetic fiber of a combination of a polyurethane core fiber and a nylon fiber so as to exhibit expanding/contracting property.

It is desired that the synthetic fiber has a thickness of about 40 deniers.

In order to achieve the above second object, the invention is concerned with a CPM device comprising a base member, a turning member coupled to the base member so as to be turned and is turned relative to the base member to effect the joint motion of the human body that is mounted or supported, and a first joint motion mechanism provided on the base member, the first joint motion mechanism including an actuator for feeding the power to the turning member, wherein the actuator is a fluid pressure actuator comprising an inner tube that expands and contracts as the fluid is fed and discharged, a mesh sleeve covering the outer periphery of the inner tube, and a low friction member obtained by so knitting fine fibers as to possess expanding/contracting properties between the inner tube and the mesh sleeve, the low friction member being so arranged as to cover the inner tube.

The actuators are provided in a plural number to reciprocally move the turning member within a predetermined angular range relative to the base member, and the air is fed to, or discharged from, the actuators depending upon the direction of turn of the turning member.

The functions of the CPM device of the present invention can be diversified by providing the turning member with an additional joint motion mechanism which effects a simple or a composite joint motion to a portion moved by the turning member and to a portion beyond thereof.

The additional joint motion mechanism includes, being provided on the turning member, a second joint motion mechanism that effects the joint motion between the portion moved by the turning member and the portion beyond thereof, a third joint motion mechanism for turning the portion moved by the turning member and the portion beyond thereof inward and outward simultaneously, and a fourth joint motion mechanism provided between the base member and the turning member to effect the joint motion of the root portion of the portion supported by the turning member, the joint motion mechanisms being incorporated in the CPM device selectively or in a composite manner.

BEST MODE FOR CARRYING OUT THE INVENTION

An embodiment of a fluid pressure actuator which is a specified invention will now be described with reference to the drawings.

Figure 1:
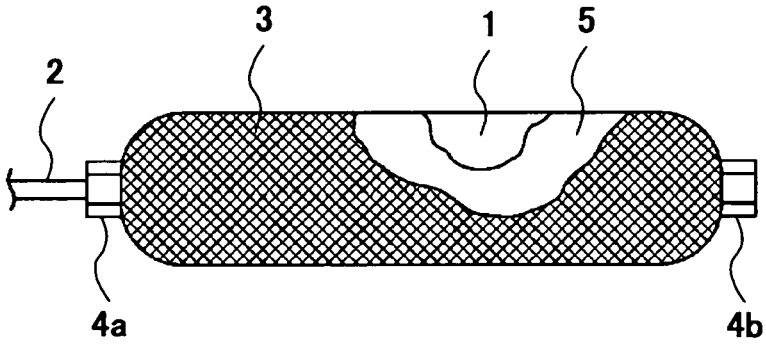
FIG. 1 is a view illustrating the structure of a first embodiment of a fluid pressure actuator of the invention which is in a state of being fed with the air.
Figure 2:
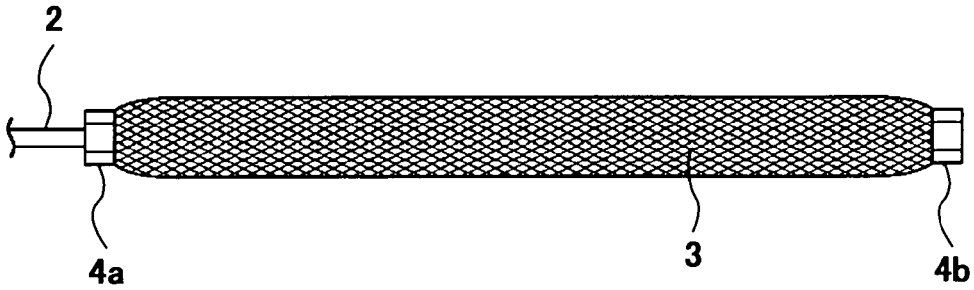
FIG. 2 is a view of the fluid pressure actuator of FIG. 1 in a discharged state.

FIG. 1 is a side view of an air pressure actuator using the air as a fluid in an expanded state according to an embodiment 1 of the invention, and FIG. 2 is a side view of the air pressure actuator of FIG. 1 in a contracted state. In FIG. 1, the mesh sleeve and the low friction member are shown being partly broken away to illustrate the internal structure of the air pressure actuator.

In FIGS. 1 and 2, a feed/discharge pipe 2 is connected to an end in the lengthwise direction of the of the inner tube 1 which is an expanding/contracting member to feed the air which is a fluid into, or discharge it from, the inner tube 1. The other end of the inner tube 1 is air-tightly closed by inserting a bush (not shown) therein. The inner tube 1 is constituted by using an elastic material such as butyl rubber or the like. An air feeding/discharging device (not shown) constituted by a small air compressor and an electromagnetic valve is connected to the feed/discharge pipe 2.

The outer periphery of the inner tube 1 is covered with a mesh sleeve 3 which is a mesh-like covering member. The mesh sleeve 3 is obtained by knitting wire members (filaments) of a highly tensile fiber such as nylon or polyester fiber that stretches very little despite a load is exerted, and its mesh has been so knitted as to cross from the two directions maintaining a predetermined angle in the lengthwise direction of the mesh sleeve 3. Upon receipt of a pressure from the inner periphery, the mesh sleeve is formed to obtain a feature which expands in the direction of diameter to shorten its length. When the pressure is released, the diameter and the length return to the initial state.

According to the mesh sleeve disclosed in the above prior art document 1, the filaments are fixed at the crossing points. In the mesh sleeve of this embodiment, however, the filaments are crossing without being fixed at the crossing points, making a difference. The mesh sleeve disclosed in the prior art document is likely to be broken due to stress produced by every motion at the crossing points of the filaments. In the mesh sleeve of the embodiment, however, the filaments are not fixed at the crossing points, and there is no problem in that the mesh sleeve breaks starting from the crossing points of the filaments due to the stress. However, this invention is not to exclude the mesh sleeve in which the filaments are fixed at the crossing points as disclosed in the prior art document 1.

Both ends of the mesh sleeve 3 in the lengthwise direction are fastened by fastening fittings 4*a* and 4*b*, and are fixed to both ends of the inner tube 1.

Between the inner tube 1 and the mesh sleeve 3, there is provided a low friction member 5 having a coefficient of friction which is smaller to the mesh sleeve 1 than to the inner tube 1. The low friction member 5 is so arranged as to cover the whole inner tube 1, and is fastened together with the mesh sleeve 3 to the inner tube 1 at both ends of the inner tube 1 by the fastening fittings 4*a* and 4*b*. When contracted, the low friction member 5 forms a cylindrical body having a circumferential length nearly equal to the outer diameter of the inner tube 1 when it is contracted. As a material of the low friction member 5, there can be used an expansible/contractible cloth used for, for example, stockings. Such a cloth has been constituted to be expansible and contractible by knitting a synthetic fiber of, for example, a combination of a polyurethane core fiber and a nylon fiber, and exhibits a coefficient of friction to the mesh sleeve obtained by knitting the resin filament smaller than a coefficient of friction to the inner tube made of a butyl rubber or a silicone rubber. It is desired that the low friction member 5 is produced as a cylindrical body by knitting fine fibers in a circumferential direction without a seam, just like the fiber that is being used, relying upon the known technology for knitting the stockings.

In this air pressure actuator, the inner tube 1 expands upon feeding the air into the inner tube. However, the material (which is not almost expansive) of the mesh sleeve 3 is not expanded, and an increase in the diameter of the inner tube 1 is converted into a decrease in the overall length. Upon discharging the air from the inner tube 1, further, the diameter of the inner tube 1 decreases and the overall length of the actuator returns back.

Owing to the provision of the low friction member 5 between the inner tube 1 and the mesh sleeve 3, there occurs no direct friction between the inner tube 1 and the mesh sleeve 3 despite of expansion and contraction, preventing the inner tube 1 from rupturing after a small number of repetitive operations and preventing the fiber of the mesh sleeve 3 from being broken. Therefore, there is provided the air pressure actuator having durability against the repetitive operation or, in other words, having a long life.

Figure 3:
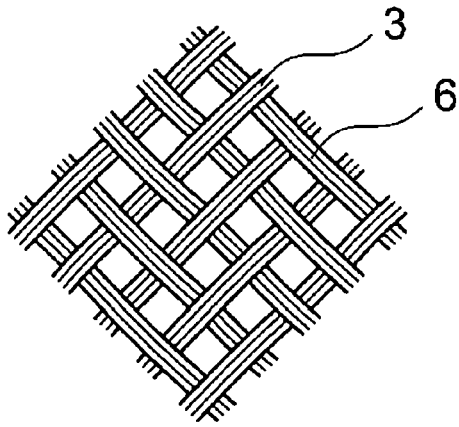
FIG. 3 is a view illustrating a portion of a mesh sleeve on an enlarged scale.

FIG. 3 is a view illustrating a portion of the mesh sleeve 3 on an enlarged scale. The mesh sleeve 3 is constituted by knitting a bundle of a plurality of polyethylene filaments 6 like a mesh. The mesh sleeve 3 assumes a fine mesh structure upon sufficiently increasing the number of the polyethylene filaments 6, i.e., upon sufficiently increasing the density of arrangement. This prevents the inner tube 1 from partly swelling through the mesh of the mesh sleeve 3 when it is expanded by feeding the air, and the inner tube 1 possesses increased durability.

In order to make sure the problems inherent in the prior art, the present inventors have tested the durability concerning a case the mesh sleeve has a rough mesh structure and a case it has a fine mesh structure. In the durability testing, there were used a mesh sleeve having 144 polyethylene filaments as a first sample of rough mesh and a mesh sleeve having 288 polyethylene filaments as a second sample of fine mesh. The two samples were knitted by the same method, and were designed to possess a diameter of about 15 mm in the initial state where no air was fed to the inner tubes and to possess a diameter which could be expanded up to 30 mm by the internal pressure after the air was fed. As the mesh sleeve for testing, further, there was used a variable-diameter mesh sleeve that has been used for protecting and binding the electric wires. In this testing, there was used no low friction member.

As a result, the first sample exhibited a pressure resistance of 0.3 MPa, a contraction factor of the length of 25% and a permissible expansion/contraction of 200 to 300 times when the load was repetitively applied. The second sample, on the other hand, exhibited a pressure resistance of 0.7 MPa, a contraction factor of the length of 30% and a permissible expansion/contraction of 7,000 to 20,000 times when the load was repetitively applied. If the results of test are described in further detail, the first sample permitted an increase in the size of the mesh near both ends of the inner tube with an increase in the number of times of expansion and contraction, developing a phenomenon in that the inner tube has swollen through the mesh when expanded. On the other hand, the second sample exhibited no change in the size of the mesh over the whole mesh sleeve in the lengthwise direction thereof and exhibited uniform expansion and contraction even after used repetitively.

It was learned from the above testing that if the mesh of the mesh sleeve is coarsened, the contraction factor of the actuator can be increased despite of a small air pressure fed into the inner tube permitting, however, the inner tube swells through the mesh of the mesh sleeve, causing the mesh sleeve to be damaged accounting for a shortened life of the actuator.

Next, to make sure the effect of the invention, a comparative testing was conducted concerning the durability by using a second sample same as the sample described above and a third sample incorporating the low friction member 5 in the second sample 2. As the low friction member for testing, there was used a portion of a stocking placed in the market (fiber size, 40 deniers).

As a result, the second sample exhibited a pressure resistance of 0.7 MPa, a contraction factor of the length of 30% and a permissible expansion/contraction of 70,00 to 20,000 times when the load was repetitively applied as described above, while the third sample exhibited a pressure resistance of 0.7 MPa, a contraction factor of the length of 30% and a permissible expansion/contraction of 80,000 to 400,000 times when the load was repetitively applied. From the above comparative testing, too, it is confirmed that the durability of the actuator is improved upon incorporating the low friction member therein.

When the air is fed into the actuator in the above embodiment, the inner tube expands in the direction of diameter, producing a tensile stress in the circumferential direction of the inner tube. Therefore, the inner tube swells through the mesh of the mesh sleeve. In the air pressure actuator of the second embodiment, no tensile stress is produced in the circumferential direction of the inner tube when the actuator is operated.

Figure 4:
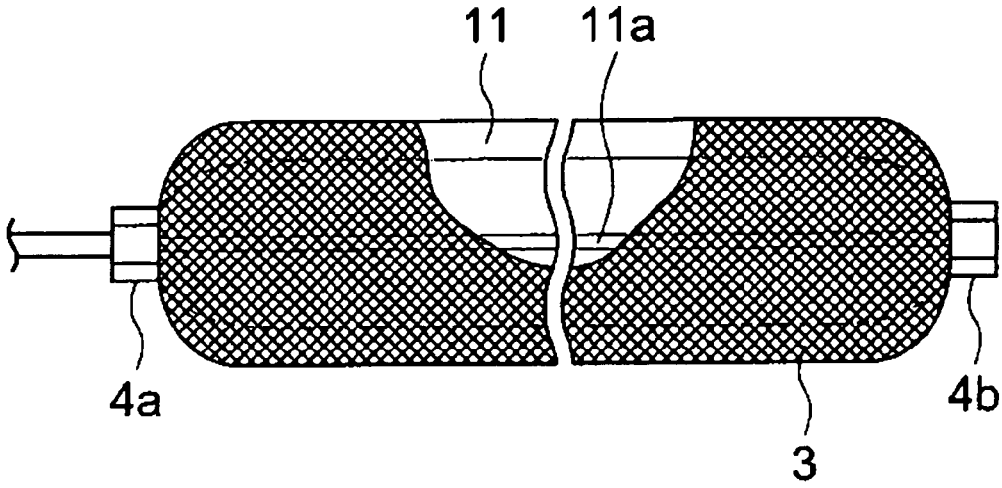
FIG. 4 is a view illustrating the structure of a second embodiment of the fluid pressure actuator of the invention which is in a state of being fed with the air.
Figure 5:
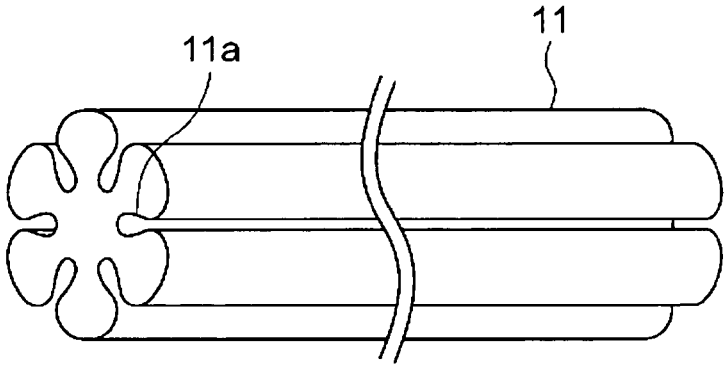
FIG. 5 is a view illustrating the appearance of an inner tube of the fluid pressure actuator shown in FIG. 4.
Figure 6:
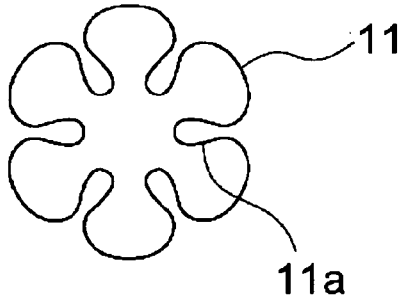
FIG. 6 is a transverse sectional view of the inner tube of FIG. 5 in the discharged state.
Figure 7:
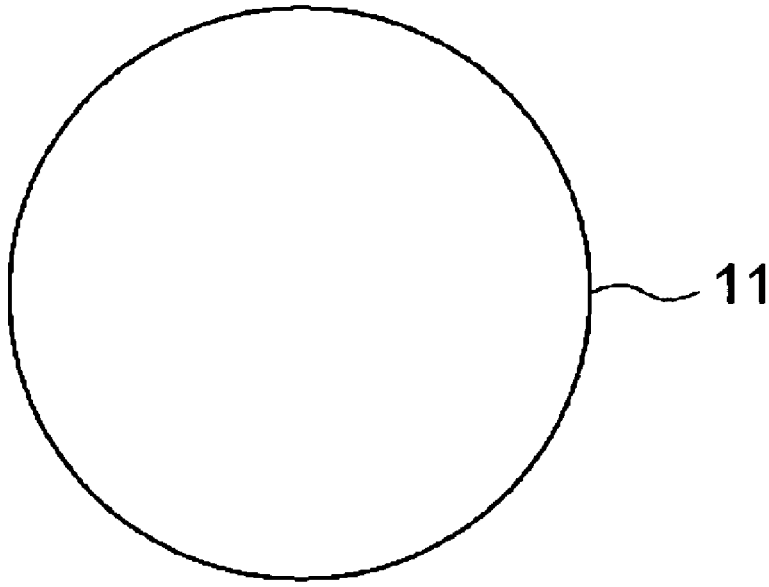
FIG. 7 is a transverse sectional view of the inner tube of FIG. 5 in a state of being expanded.

FIG. 4 is a side view of the air pressure actuator according to the embodiment 2 of the invention, FIG. 5 is a perspective view of the inner tube shown in FIG. 4, FIG. 6 is a transverse sectional view of the inner tube of FIG. 5, and FIG. 7 is a transverse sectional view of the inner tube of FIG. 5 in the expanded state. In FIG. 4, the mesh sleeve is shown being partly broken away to illustrate the inner structure of the actuator.

In the drawings, the inner tube 11 which is an expanding/contracting member is so constituted that the sectional area of the region surrounded by the tube increases while maintaining the same surface area in a step where it is shifted from the contracted state to the expanded state. That is, the inner tube 11 is provided with a plurality of ridge-like portions 11*a* that protrude inward at the time of contraction with an equal distance in the circumferential direction of the tube. When the inner tube 11 expands, the ridge-like portions 11*a* are expanded as shown in FIG. 7 and the sectional area increases in the area surrounded by the inner tube 11.

The inner tube 11 is constituted by using an elastic material having expanding/contracting properties, such as butyl rubber or silicone rubber like in the embodiment shown in FIG. 1. The outer circumference of the inner tube 11 is covered with the mesh sleeve 3 which is a mesh-like covering member. The mesh sleeve 3 is constituted in the same manner as in the embodiment 1.

In this embodiment, the circumferential length of the inner tube 11 in cross section (circumferential length in FIG. 7) when it has expanded is not greater than 2.2 times of the circumferential length of the inner tube 11 in cross section (circumferential length of a circle circumscribing the cross section of FIG. 6).

Next, described below is the operation of the embodiment 2. When the air is fed into the inner tube 11, the sectional area increases in the region surrounded by the inner tube 11 causing no change in the surface area of the inner tube 11. That is, in the inner tube 11 of the embodiment 2, the sectional shape of the tube so varies that the sectional area surrounded by the inner tube 11 increases while maintaining the same the circumferential length in cross section. As the inner tube 11 expands as described above, the overall length of the actuator is shortened to produce a driving force across both ends of the actuator. To put this embodiment into practice, a relationship between the mesh sleeve 3 and the inner tube 11 may be so set that the actuator contracts by a predetermined length when the ridges of the inner tube 11 are all expanded as shown in FIG. 7 such that the inner tube 11 becomes a circle in cross section.

Upon discharging the air from the inner tube 11, the actuator whose overall length is shortened permits the inner tube 1 to return back to the sectional shape shown in FIG. 6, i.e., to resume the initial length.

The air pressure actuator of the embodiment 2 enables the tube to expand without utilizing the elasticity of the inner tube 11 or, in other words, without producing the tensile stress in the circumferential direction of the tube. Therefore, the inner tube 11 does not swell through the mesh of the mesh sleeve 3. Therefore, there is a decreased probability in that the inner tube 11 is scarred and the scar spreads accompanying the expansion. Besides, no tensile stress acts on the inner tube 11 at the time of expansion. Therefore, even when the tensile stress repetitively acts upon the inner tube, plastic deformation does not occur in the inner tube and properties of the inner tube 11 can be stably maintained. Therefore, the inner tube 11 exhibits increased durability and the life of the actuator is lengthened.

According to the embodiment 2, further, the inner tube expands by an amount of the air that is fed and, hence, the actuator produces the force of nearly linear characteristics. Besides, since there is no plastic deformation in the inner tube, the hysteresis loss decreases making it possible to improve precision for controlling the expansion and contraction of the actuator.

In the above second embodiment 2, the supply of the air was so controlled as to maintain the surface area of the inner tube 11 the same. However, if it is within a range of elastic deformation of the material of the inner tube 11, the air may be fed to such a level that the surface area of the inner tube 11 increases to some extent beyond the state of FIG. 7. In this case, too, no tensile force is produced in the inner tube 11 in most of the portions of the inner tube 11 in the step of expansion, and the durability of the inner tube 11 can be enhanced.

Further, the structure of the inner tube 11 may be such that the ridge-like portions expand from the initial stage of expansion while permitting the surface area of the inner tube 11 to increase. In this case, too, the amount of elastic deformation of the inner tube 11 is smaller than when there is provided no ridge-like portions, enabling the inner tube 11 to exhibit improved durability.

In the embodiment 2, the mesh sleeve 3 was arranged to surround the periphery of the inner tube 11. Here, a low friction member 5 like that of the embodiment 1 may be provided between the inner tube 11 and the mesh sleeve 3.

Figure 8:
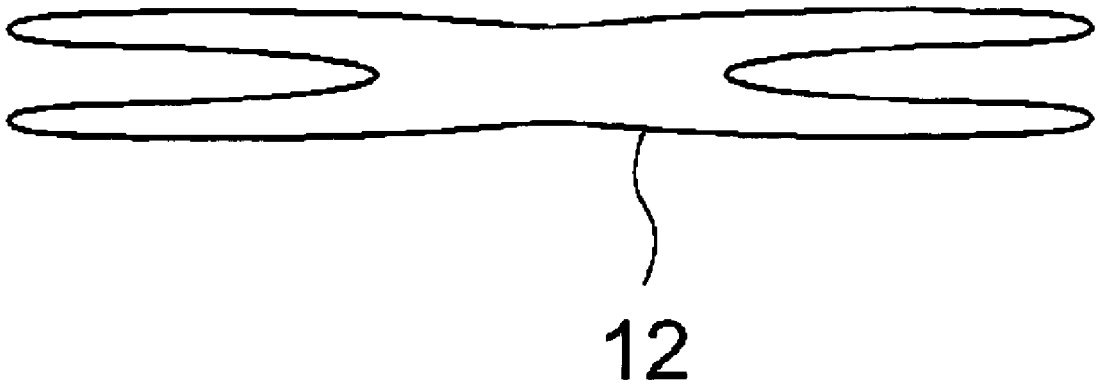
FIG. 8 is a transverse sectional view of the inner tube according to another embodiment in the discharged state.

Next, described below is an air pressure actuator according to a third embodiment of the present invention. FIG. 8 is a transverse sectional view of when the inner tube of the embodiment 3 of the invention is contracted. As shown in FIG. 8, when contracted, the inner tube 12 is folded in cross section. When this inner tube 12 is used, too, the transverse sectional area of the region surrounded by the inner tube can be increased without varying the surface area of the inner tube at the time when it is expanded. Therefore, the embodiment 3, too, makes it possible to improve the durability of the inner tube 12, to lengthen the life of the actuator and to improve the precision for controlling the expansion and contraction.

Though the actuator using the air pressure was described above as the air pressure actuator of the invention, it should be noted that the present invention is in no way limited thereto only. For example, the fluid fed to the expansible/contractible member is not limited to the air but may be a variety of gases or liquids depending upon the use.

Further, the embodiments 1 to 3 have dealt with a slender tubular actuator only. However, the invention can be further applied to a variety of fluid pressure actuators varying the shape of the expanding/contracting member.

The transverse sectional shapes of the inner tubes of the embodiments 2 and 3 when contracted are not limited to those shown in FIGS. 5 and 8 only but may further be the one in which the ridges are formed in a star-like shape.

Further, the fluid pressure actuator of the present invention can be used as an actuator for driving a worn-type robot which a man wears, i.e., can be used as an artificial muscle. The actuator can be further used for driving industrial robots and construction machinery. Further, the actuator can be used for driving a rehabilitation equipment for a physically handicapped person who has disorder on his joint. Namely, the fluid pressure actuator of the invention can be used for equipment in a wide field of applications.

According to the present invention as described above, a low friction member is provided between an expanding/contracting member and the covering member, the low friction member having a coefficient of friction which is smaller for the covering member than for the expanding/contracting member, enabling the actuator to exhibit improved durability, i.e., extended life when used repetitively.

The invention further uses the expanding/contracting member that expands so that the area increases in the region that is surrounded while maintaining the surface area constant in at least part of a step where the contracted state is shifted to the expanded state. Therefore, the actuator exhibits increased durability, i.e., long life when used repetitively.

Figure 9:
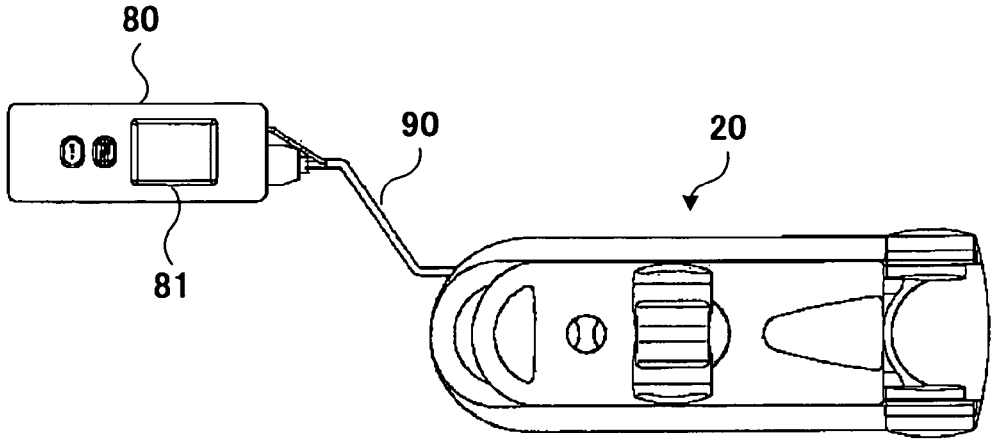
FIG. 9 is a view of appearance of the whole constitution of a CPM device of the invention.

Next, described below is a CPM device related to the present invention. FIG. 9 is a view schematically illustrating the constitution of the CPM device having the fluid pressure actuator as a constituent element. In FIG. 9, reference numeral 20 denotes a main CPM device, 80 denotes a control device of the box type, and 90 denotes an air hose connected between the main CPM device 20 and the control device 80. Though FIG. 9 illustrates only one hose, a bundle of a plurality of air hoses are connected from the electromagnetic valve in the control unit to the air actuators of various types. Though not shown, the control device 80 includes, in the box, an air compressor, an electromagnetic valve, a central control unit (CPU) and a circuit for electrically connecting them, as well as an external power source plug for feeding electric power to them. The compressor is for producing the compressed air, the electromagnetic valve is for feeding and discharging the air to, and from, the actuator, and the CPU is for controlling the operation of the CPM device, wherein a ROM in the CPU is storing a plurality of operation sequences for the CPM device. The control device 80 of the control box type is provided with an operation panel 81. The electromagnetic valve may be provided near each actuator. By providing the electromagnetic valve near the actuator, it is allowed to improve the efficiency for feeding the air to the actuator and to improve the efficiency for discharging the air from the actuator.

When the CPM device is constituted as shown in FIG. 9, the above-mentioned fluid pressure air actuator is incorporated in the main CPM device as a drive actuator, and a heavy component such as the air compressor is provided being separated away from the main CPM device, enabling the main CPM device to be easily transited and operated.

Next, a first embodiment of the CPM device 20 will be described with reference to FIGS. 10 to 12.

Figure 10:
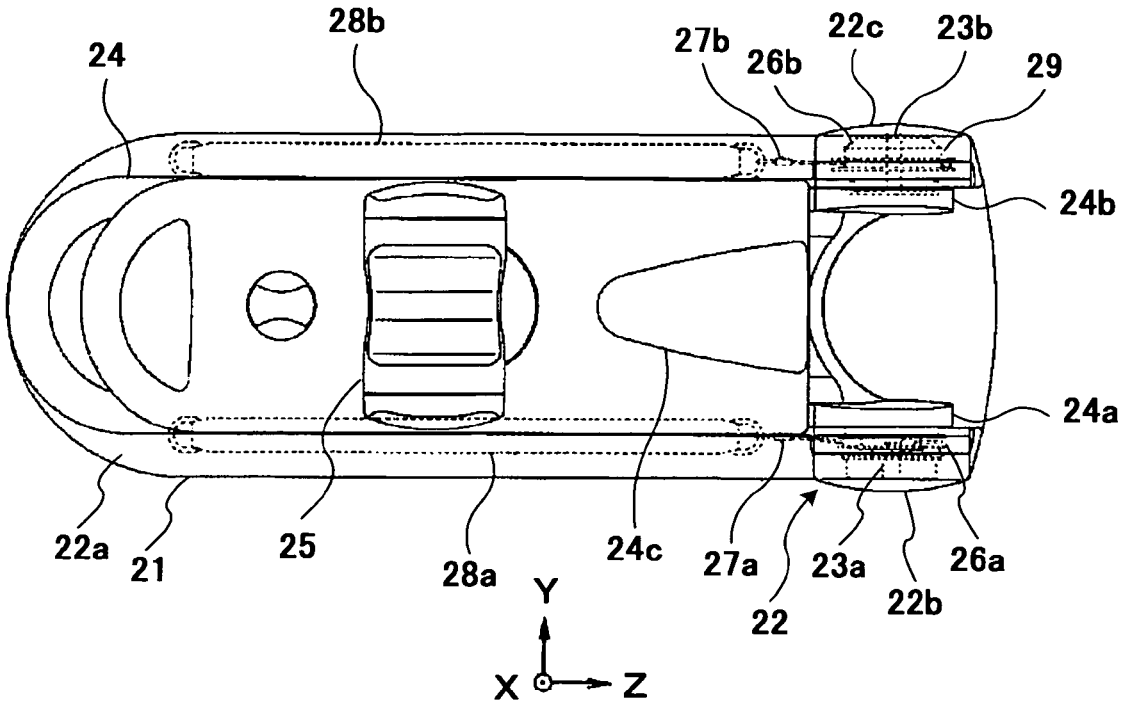
FIG. 10 is a plan view of a first embodiment of the CPM device of the invention.
Figure 11:
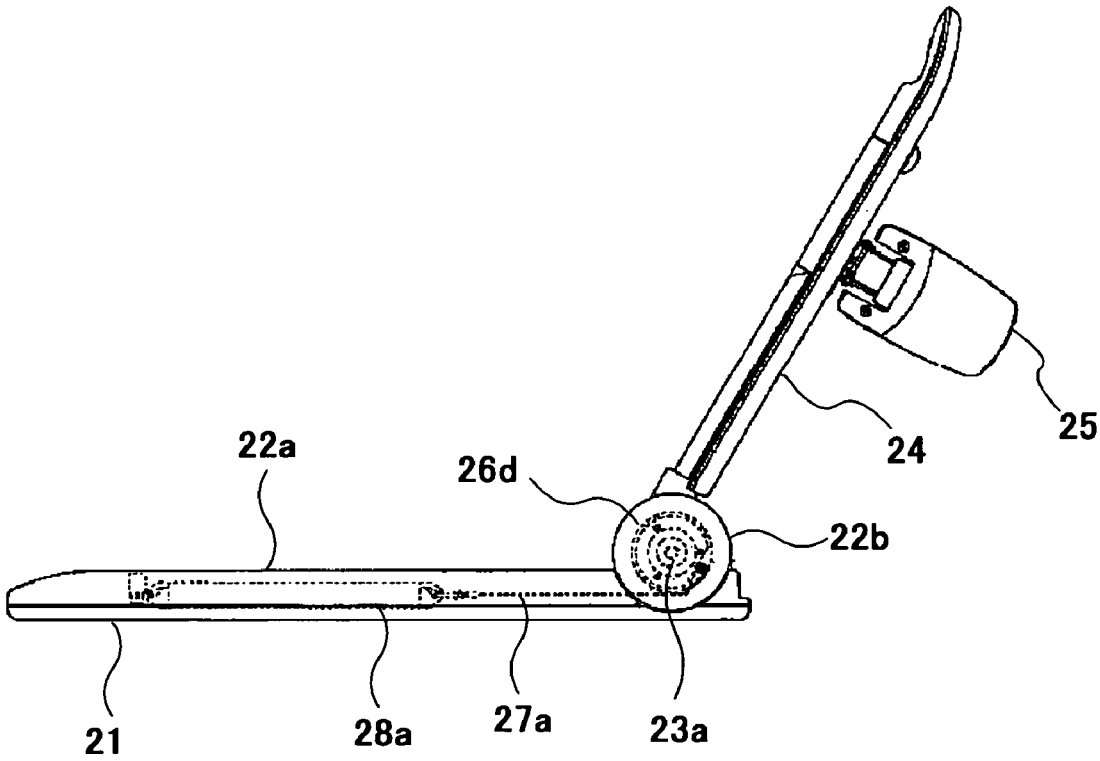
FIG. 11 is a side view illustrating the lower side of FIG. 10.
Figure 12:
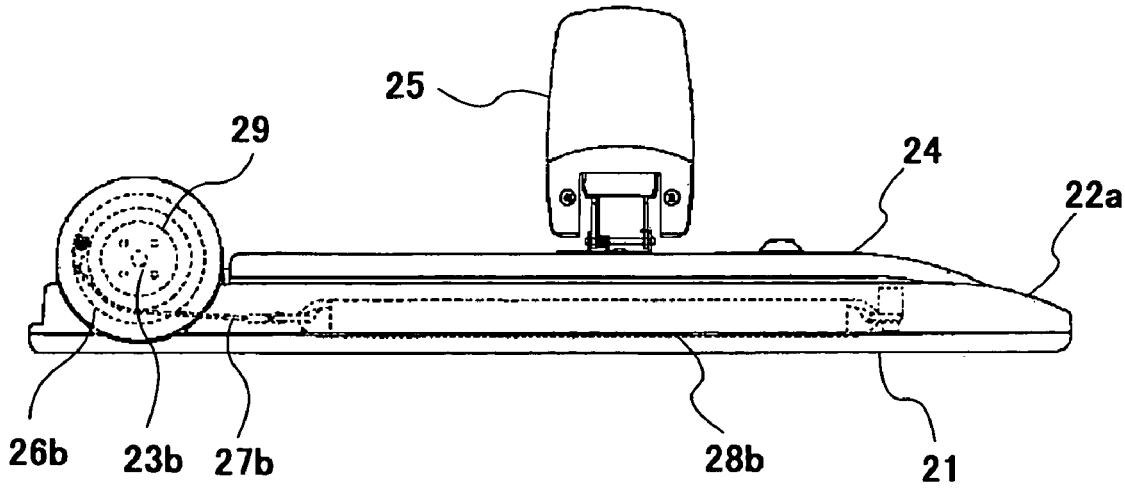
FIG. 12 is a side view illustrating the upper side of FIG. 10.

FIG. 10 is a plan view of the CPM for performing the bending/stretching motion of an elbow, FIG. 11 is a lower plan view of the CPM device shown in FIG. 10 and illustrates a state where the elbow is bent, and FIG. 11 is an upper plan view of the CPM shown in FIG. 10 and illustrates a state where the elbow is stretched.

In FIG. 10, reference numeral 21 denotes a base plate serving as a base for the CPM device. A rotary support portion 22 is provided on the upper surface of the base plate 21. The rotary support portion 22 includes a rotary support member 22*a* disposed on the upper surface of the base plate 21, and a set of rotary support portions 22*b*, 22*c* provided at an upper and lower portions of the rotary support member 22*a* at the right end in the drawing. The rotary support portions 22*b*, 22*c* are provided with rotary shafts 23*a*, 23*b* in parallel with the Y-axis in FIG. 1. A forearm support plate 24 for supporting the forearm of a man is rotatably coupled by the shafts 23*a*, 23*b* to the rotary support portions 22*b*, 22*c*. The elbow of the human body is placed midway between the set of rotary support portions 22*b* and 22*c*, and the forearm is supported by the forearm support plate 24. The rotary support member 22*a* has nearly the same width as the base plate 21, i.e., thick at both ends in the direction of width, thin at the central portion, and is hollow in the inside to also work as a cover for covering the base plate 21. The forearm support plate 24 is allowed to turn between a horizontal state shown in FIG. 12 and a state of being erected at about 120° shown in FIG. 11.

The forearm support plate 24 has an upper surface which is nearly flat, has a back surface which is nearly a plate-like member of a shape that runs along the upper surface of the rotary support member 22*a*, and has coupling members 24*a*, 24*b* at the right end in the drawing so as to be coupled to the rotary shafts 23*a*, 23*b* attached to the rotary support portions 22*b*, 22*c*. The forearm support plate 24 is provided with a holding member 25 for loosely holding the palm portion, and a recessed portion 24*c* is formed in a portion of the forearm support plate 24 in order to prevent a portion beyond the elbow from coming in contact with the edge of the forearm support plate 24. When the CPM device is to be used, the user places his elbow near the rotary support portion and stretches the forearm on the forearm support plate 24. Here, the holding member 25 is disposed at such a position that the palm is loosely held by the holding member 25.

The support plate 24 is coupled to the rotary shafts 23*a*, 23*b* of the rotary support portions 22*b*, 22*c* via coupling members 24*a*, 24*b*. The rotary shafts 23*a*, 23*b* are rotatably supported by the rotary support portions 22*b*, 22*c* relying upon the support structures at both ends. Pulleys 26*a*, 26*b* are fixed to the rotary shafts 23*a*, 23*b*, and wires 27*a*, 27*b* are wound on the pulleys 26*a*, 26*b*. The wires 27*a*, 27*b* are fixed at the ends on one side thereof to the pulleys 26*a*, 26*b*. The diameter of the grooves of the pulleys 26*a*, 26*b* on which the wires are wound can be determined by taking into consideration the moment for turning the forearm support plate 23 (product of the weight of the forearm support plate and the distance from the center of turn to the center of gravity<product of the contracting force of the actuator and the diameter of the groove). Further, the amount of winding the wires 27*a*, 27*b* on the pulleys 26*a*, 26*b* can be determined by taking into consideration the turning angle of the forearm support plate 24.

Between an end of one wire 27*a* of the two wires and the base plate 21 or the rotary support member 22*a* (desirably, between an end of the one wire 27*a* and the rotary support member 22*a*), there is provided a tubular air actuator 28*a* as the fluid pressure actuator (air pressure actuator) for producing the driving force to turn the forearm support plate 24 by about 120° from the horizontal state. Further, between an end of the other wire 27*b* of the wires 27 and the base plate 21 or the rotary support member 22*a* (desirably, between an end of the other wire 27*b* and the rotary support member 22*a*), there is provided a tubular air actuator 28*b* as the fluid pressure actuator (air pressure actuator) for producing the driving force to return the forearm support plate 24 from the state where it has been turned by 120° back to the horizontal state.

If described in further detail, the one end of the tubular air actuator 28*a* is connected to the one end of the wire 27*a*, and the other end of the wire 27*a* is introduced into the pulley 26*a* and is fixed to the pulley 26*a* as shown in FIG. 10. Further, the one end of the tubular air actuator 28*b*, too, is connected to the one end of the wire 27*b*, and the other end of the wire 27*b* is introduced into the pulley 26*b* and is fixed to the pulley 26*b* as shown in FIG. 11.

Here, however, the tubular actuator 28*b* is for returning the forearm support plate 24 back from the state shown in FIG. 11. Therefore, a mechanism is necessary for turning the forearm support plate 24 in a direction opposite to the turn of the pulley 26*b* when the tubular actuator 28*b* has operated. Though simply illustrated in FIG. 12, the reversely operating mechanism 29 is constituted as described below if described in detail. That is, the pulley 26*b* is rotatably attached to the rotary shaft 23*b*, and a bevel gear A is fixed to the pulley 26*b* in concentric therewith. Two small bevel gears B are arranged to be in mesh with the bevel gear A with the rotary shaft 23*b* held therebetween. Further, a bevel gear C is arranged to be in mesh with the two bevel gears B, the bevel gears B being fixed to the rotary shaft 23*b*. With the reversely operating mechanism 29 being constituted as described above, the force transmitted from the wire 27*b* to the pulley 26*b* is further transmitted from the bevel gear A to the bevel gear C via the bevel gears B. Here, the bevel gear A and the bevel gear C rotate in the opposite directions. Therefore, if the tubular actuator 28*b* is operated, the forearm support plate 24 is turned toward the horizontal direction from the state shown in FIG. 11. The above reversely operating mechanism 29 is for rendering the direction in which the wire 27*b* is introduced into the pulley 26*b* to be the same as the direction in which the wire 27*a* is introduced into the pulley 26*a*. It is possible to simplify the reversely operating mechanism by introducing the wire 27*b* into the pulley 26*b* from a direction opposite to the above direction by separately providing an auxiliary pulley.

The above tubular air actuators 28*a*, 28*b* are the air pressure actuators of the type shown in FIGS. 1 and 4 as described in the specified invention. The tubular actuators 28*a*, 28*b* may be of the same specifications or of different specifications. When they are of different specifications, the actuator 28*a* should be the one having a strong contracting force to erect the forearm support plate 24 from the horizontal state, and the actuator 28*b* should be the one having a weak contracting force to return the forearm support 24 back to the horizontal state.

The air is fed from an air feeding/discharging device (not shown) comprising, for example, an air compressor and an electromagnetic valve into the inner tube of the actuator through the air tube (not shown) connected to the one end of the tubular actuator 28*a*, so that the length of the tubular actuator 28*a* is shortened. When the contracting force produced by the tubular air actuator 28*a* is transmitted to the wire 27*a*, the pulley 26*a* rotates, and the forearm support plate 24 rotates in a direction of being erected shown in FIG. 10 from the horizontal state of FIG. 9. The air is discharged from the tubular air actuator 28*a* and, at the same time, the air is fed from an air feeding/discharging device (not shown) comprising, for example, an air compressor and an electromagnetic valve into the inner tube of the actuator through the air tube (not shown) connected to the one end of the tubular actuator 28*b*, so that the length of the tubular actuator 28*b* is shortened. When the contracting force produced by the tubular air actuator 28*b* is transmitted to the wire 27*b*, the pulley 26*b* rotates and, at the same time, the reversely operating mechanism 29 operates, causing the forearm support plate 24 to be rotated toward the horizontal direction. The forearm support plate 24 is reciprocally operated by the alternate contracting operations of the tubular actuators 28*a* and 28*b* in the lengthwise direction. Thus, the elbow bending/stretching operation is effected. The rotational speed of the forearm support plate 24 can be arbitrarily varied by adjusting the amount of the air fed to, or discharged from, the tubular actuators 28*a*, 28*b* per a unit time by controlling the opening of the electromagnetic valve depending upon the degree of disorder or the degree of recovery of the handicapped person.

Figure 13:
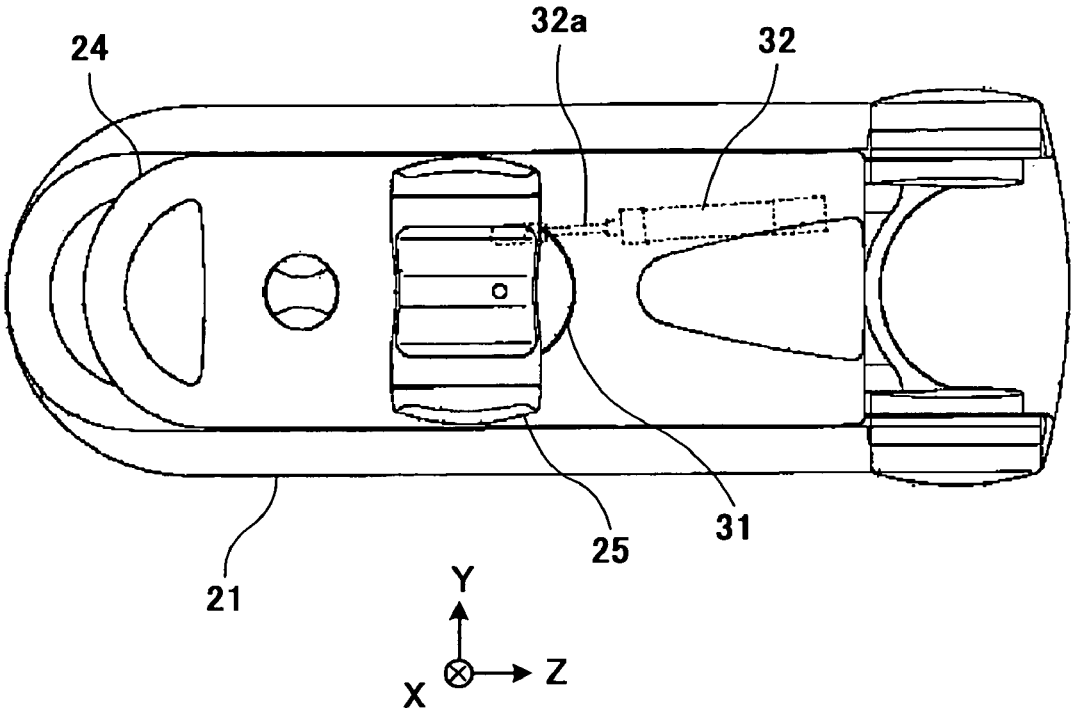
FIG. 13 is a plan view of a second embodiment of the CPM device of the invention.
Figure 14:
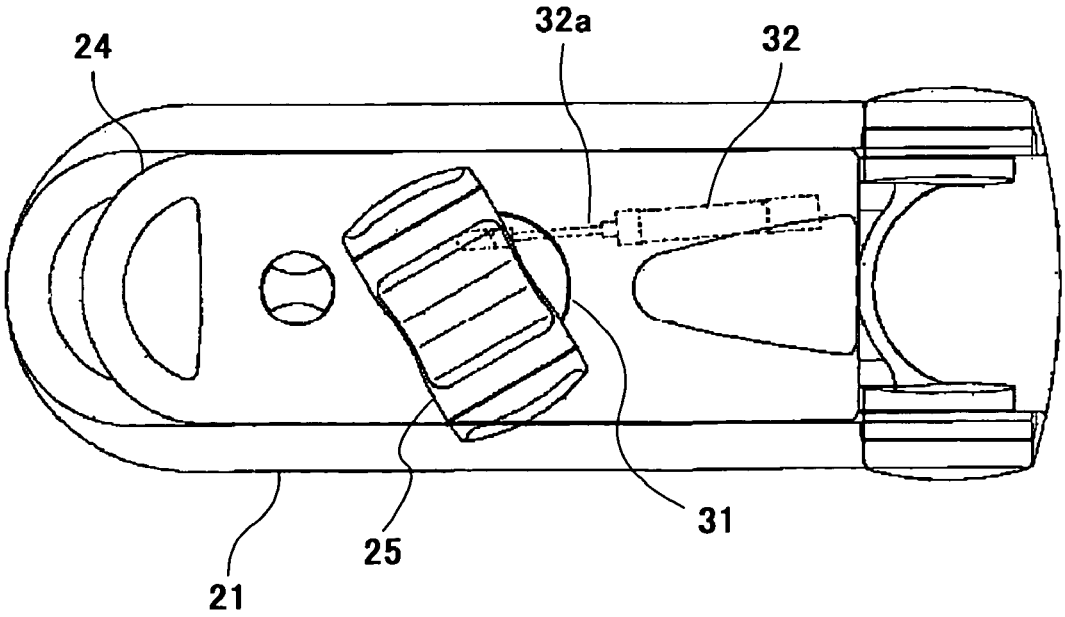
FIG. 14 is a view illustrating a state where a holding member of the CPM device of FIG. 13 is turned.

Next, described below is a second embodiment of the CPM device of the present invention. FIG. 13 is a plan view of the CPM device of the second embodiment in which a wrist bending/stretching mechanism is incorporated in the CPM device of the first embodiment of the invention shown in FIG. 10, and FIG. 14 is a plan view illustrating a state where the wrist bending operation is effected in the CPM device of the second embodiment. The forearm support plate 24 is provided with a disk-like turntable 31. The turntable 31 is mounted on the forearm support plate 24 so as to be turned about an axis in parallel with the X-axis of FIG. 13, i.e., so as to be turned about an axis that meets at right angles with the upper surface of the forearm support plate 24. The holding member 25 is mounted on the turntable 31. Therefore, the holding member 25 turns together with the turntable 31.

A first air cylinder 32 is disposed on the back side of the forearm support plate 24 to turn the turntable 31. An end of a rod (plunger) 32*a* of the first air cylinder 32 is coupled to an end of an arm (not shown) coupled to the rotary shaft of the turntable 31 at a position of a predetermined distance from the center of turn of the turntable 31 and, besides, an end of the cylinder body of the first air cylinder 32 is coupled to the forearm support plate 24. A point where the end of rod of the first air cylinder 32 is connected to the rotary table 31 can be determined depending upon the angle by which the turntable 31 has turned (reciprocally operated) and the stroke of the rod. The member for connecting the turntable 31 to the first air cylinder 32 may be a disk-like member instead of the above-mentioned arm which is not shown.

In the thus constituted mechanism for operating the holding member 25, the air is fed and discharged by a source of feeding the air comprising the air compressor and the electromagnetic valve through a hose connected to the first air cylinder 32, and the holding member 25 is turned by the turn of the turntable 31 as shown in FIG. 14. It is therefore made possible to effect the motion for stretching the wrist held by the holding member 25.

Figure 15:
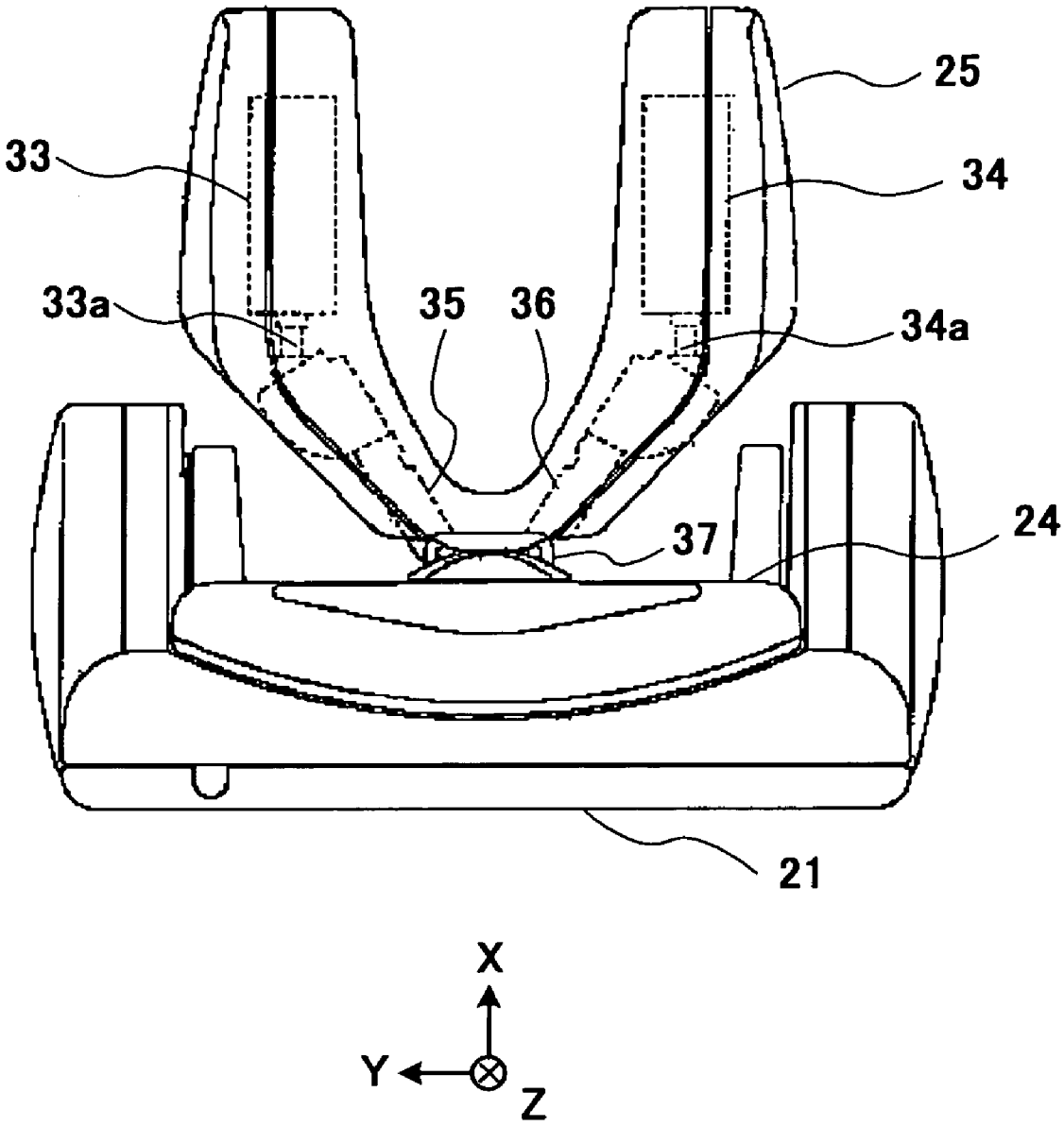
FIG. 15 is a view illustrating the structure of a mechanism for swinging the holding member.

Next, described below is a third embodiment of the CPM device of the present invention. This embodiment is the one in which a forearm twisting motion mechanism is added to the CPM device of the first and second embodiments. FIG. 15 is a view illustrating the forearm twisting motion mechanism incorporated in the CPM device of the embodiment shown in FIG. 10 or 13, and is a view of the left side of FIG. 10 or 13. In FIG. 15, the interior of the holding member 25 is formed hollow, a second air cylinder 33 and a third air cylinder 34 are arranged in the hollow portion, and the main portions of the air cylinders are fixed thereto. A first link 35 and a second link 36 are rotatably connected to the rods (plungers) 33*a* and 34*a* of the air cylinders 33 and 34, and the ends on the other side of the first link 35 and the second link 36 are rotatably connected to a connection fitting 37 provided on the forearm support plate 24 or the turntable 31. Though not shown, air hoses for feeding the air are connected to the second cylinder 33 and to the third cylinder 34, the air hoses running along the hollow portion of the holding member 25, extending from the central portion of the holding member 25 to the back surface of the forearm support plate 24, and being bundled together with other air hoses.

Figure 16:
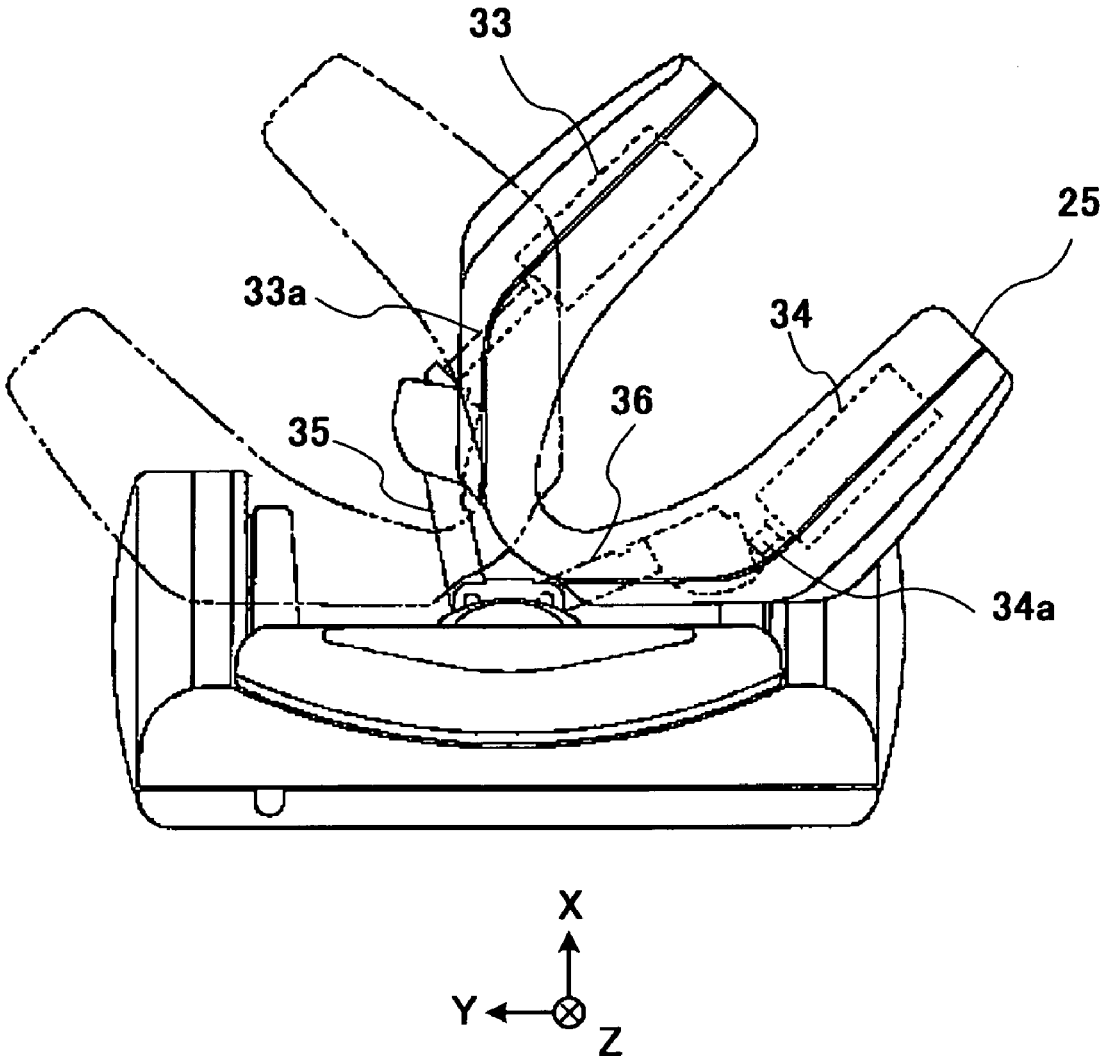
FIG. 16 is a view illustrating the operation for swinging the holding member.

In the thus constituted forearm twisting motion mechanism, the air is exclusively fed to the second cylinder 33 and to the third cylinder 34 from the source of feeding the air comprising the air compressor and the electromagnetic valve, causing the holding member 25 to swing with the connection fitting 37 as a center. When the air is fed, for example, to the first cylinder 33 as shown in FIG. 15, the rod 33*a* of the second cylinder 33 protrudes. Despite the rod 33*a* of the second cylinder 33 has protruded, no air is fed to the third cylinder 34. Therefore, no change occurs in the coupled state of the third cylinder 33 and the second link 36, and the holding member 25 is pushed by the main body of the second cylinder 33 by an amount the rod 33*a* of the second cylinder 33 has extended. Namely, the holding member 25 swings and tilts as shown in FIG. 16. When the air is fed to the third cylinder 34 after the holding member 25 has swung as shown in FIG. 16, the holding member 25 swings in a direction (direction of a two-dotted chain line in the drawing) opposite to the above operation. Therefore, the rotational force is transmitted in reciprocal direction to the palm held by the holding member 25. The forearm, therefore, is twisted turning outward and inward. The swinging speed and the swinging angle of the holding member 25 can be adjusted by controlling the opening of the electromagnetic valve. That is, the opening of the electromagnetic valve is increased to increase the swinging speed of the holding member 25, and the opening of the electromagnetic valve is decreased to lower the swinging speed. Further, the swinging angle of the holding member 25 can be adjusted by controlling the amount of feeding the air to the cylinder or controlling the opening time of the electromagnetic valve.

Figure 17:
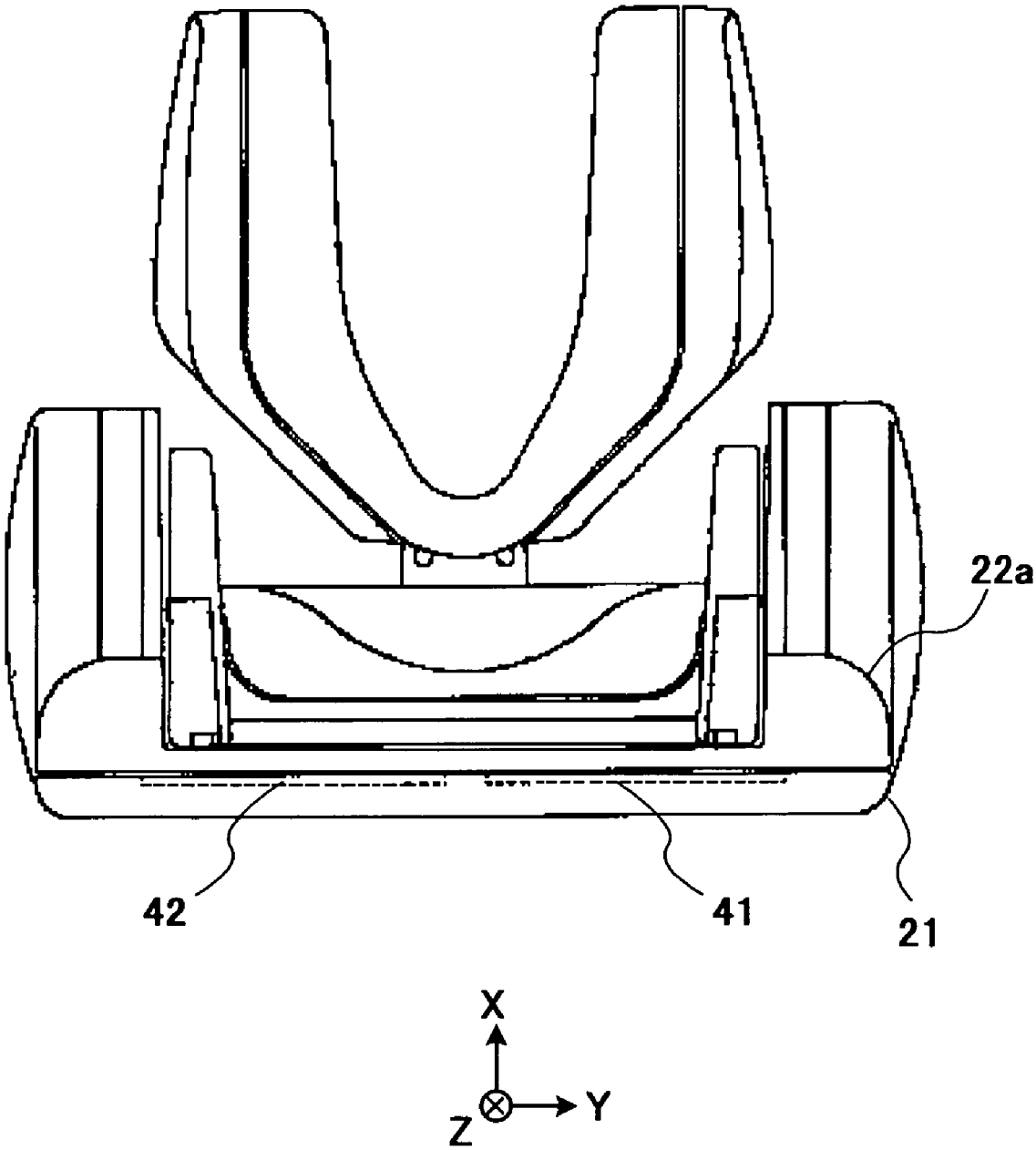
FIG. 17 is a front view illustrating a third embodiment of the CPM device of the invention.

Next, the CPM device according to a third embodiment of the invention will be described with reference to FIG. 17.

The PCM device of the third embodiment is suited for effecting the bending motion for the shoulder/scapular arch of the human body, and is the one accomplished by adding a shoulder/scapular arch bending motion mechanism to the CPM device of FIGS. 10, 13 and 15. FIG. 17 is equivalent to a view illustrating the right side of FIG. 10 or FIG. 13. Referring to FIG. 17, a first pad-shaped air actuator 41 and a second pad-shaped air actuator 42 are arranged between the base plate 21 and the rotary support member 22*a*, being arranged in the direction of Y-axis in the drawing. It is desired that their positions are as close as possible to the position where the elbow is placed. Therefore, the pad-shaped actuators are arranged at positions close to the rotary portions 22*b*, 22*c* of the rotary support member 22*a*. A plane is formed by, for example, fitting a closure to the hollow portion where the rotary support member 22*a* is corresponded to the positions where the pad-shaped air actuators are disposed.

The pad-shaped actuators 41, 42 are connected, through hoses, to the source of feeding the air that includes the compressor and the electromagnetic valve. The pad-shaped air actuators 41 and 42 expand upon being fed with the air, and work to lift up the rotary support member 22*a* to form a gap between the rotary support member 22*a* and the base plate 21. The air can be fed to the pad-shaped air actuators 41 and 42 by either a controlling method of alternately feeding and discharging the air or a controlling method of simultaneously feeding and discharging the air. These methods can be selected by a control device.

Figure 18:
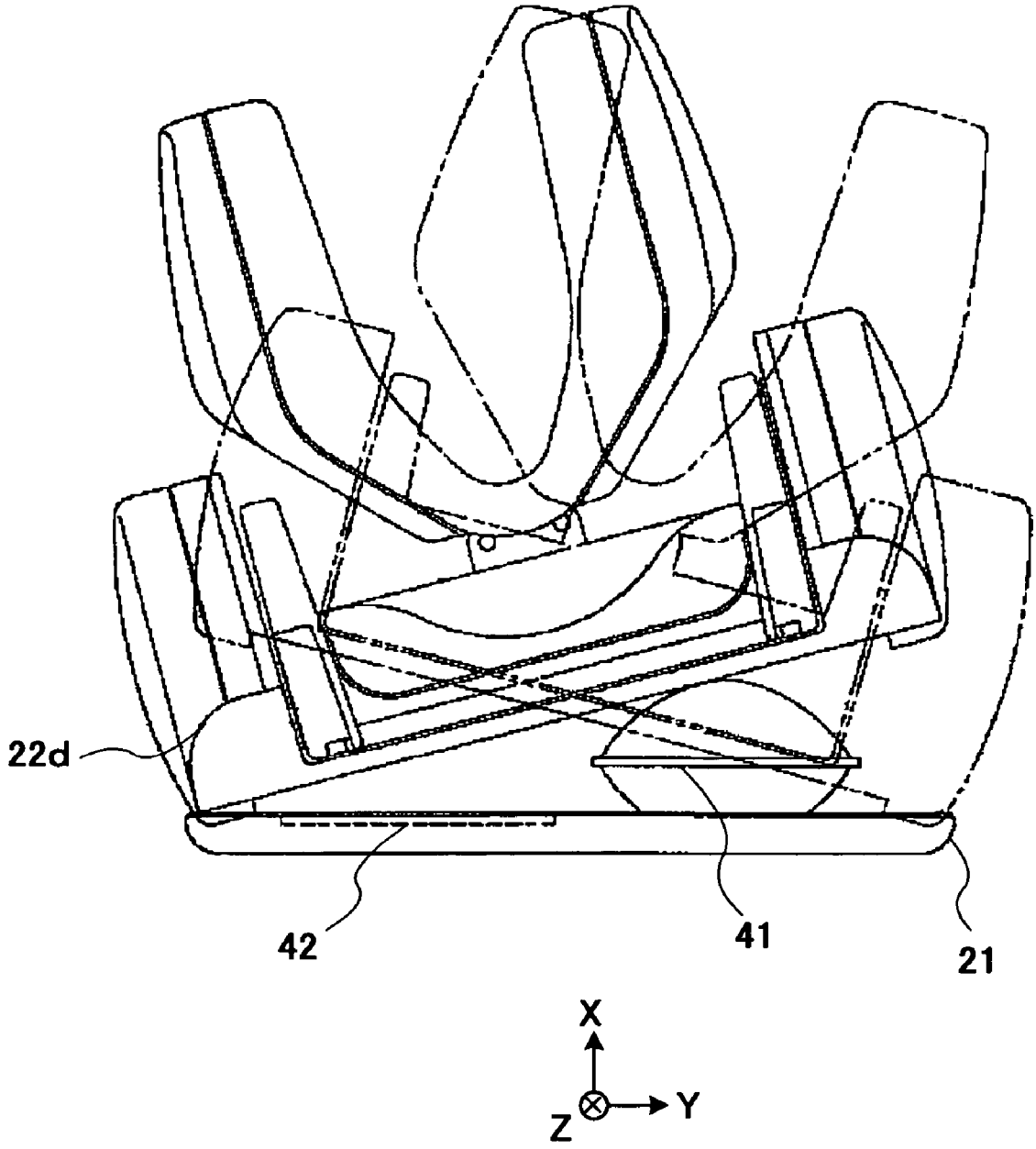
FIG. 18 is a view illustrating the operation of an air actuator shown in FIG. 17.

In these control methods, if the air is alternately fed to, and discharged from, the pad-shaped air actuators 41 and 42, the rotary support member 22*a* swings (see FIG. 18). Therefore, the shoulder/scapular arch of the human body can be bent and stretched by placing the forearm in the CPM device. Further, if the air is simultaneously fed to, and discharged from, both the pad-shaped air actuators 41 and 42, the shoulder of the human body can be moved up and down by placing the forearm on the CPM device. The swinging amount, amount of up-and-down motion and the moving speed of the rotary support member 22*a* can be arbitrarily set by controlling the amount of feeding the air to the pad-shaped air actuators 41, 42 or by controlling the amount of feeding the air per a unit time by controlling the opening of the electromagnetic valve.

Figure 19:
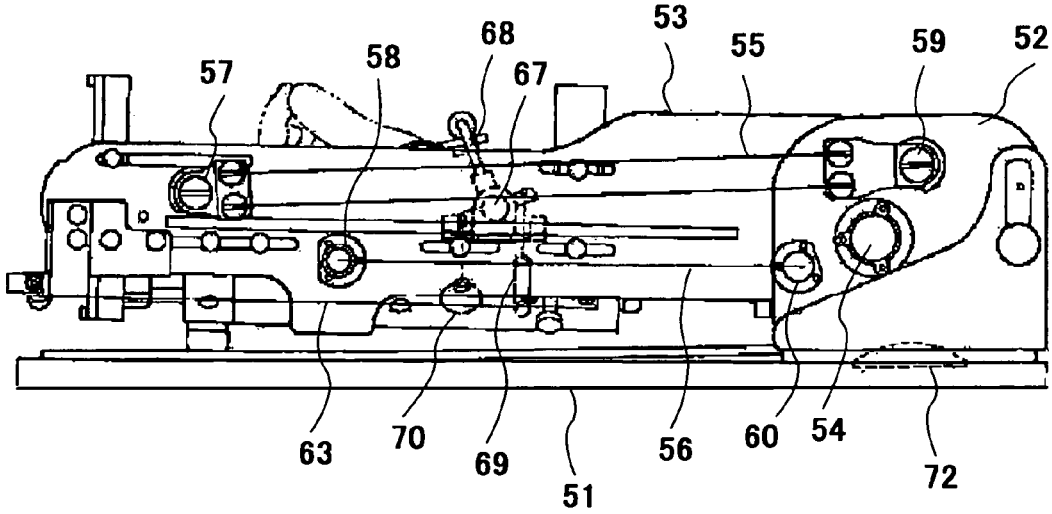
FIG. 19 is a view illustrating the structure of a major portion of a fourth embodiment of the CPM device of the invention.
Figure 20:
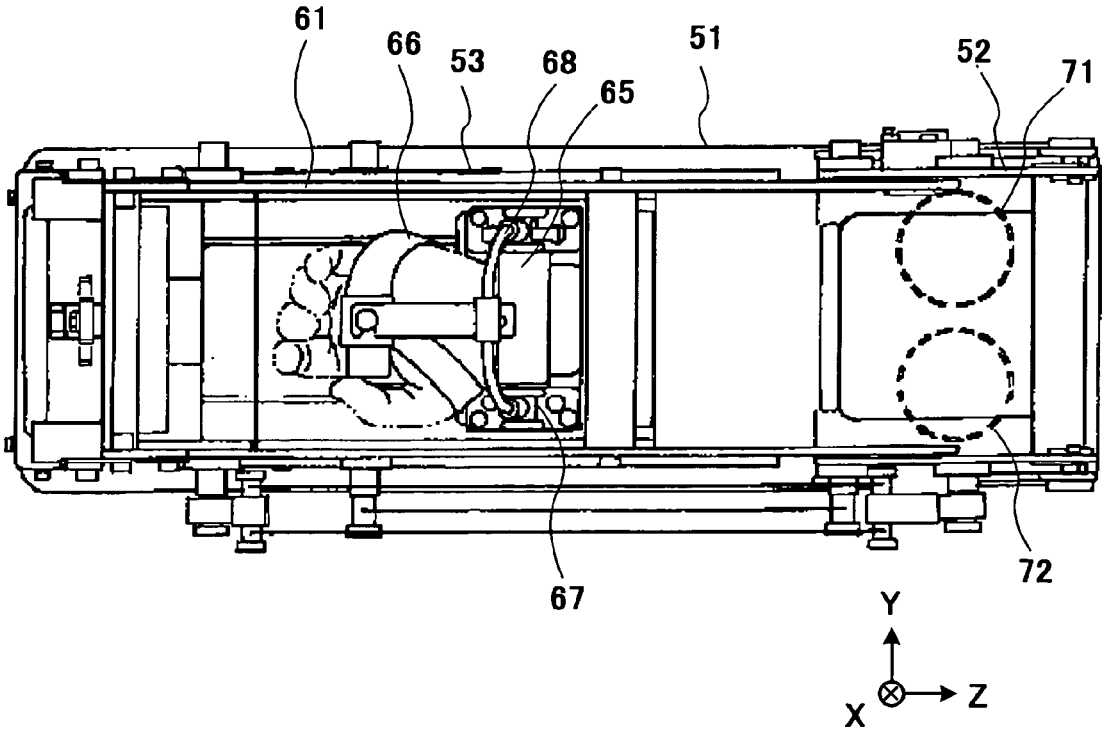
FIG. 20 is a plan view of FIG. 19.
Figure 21:
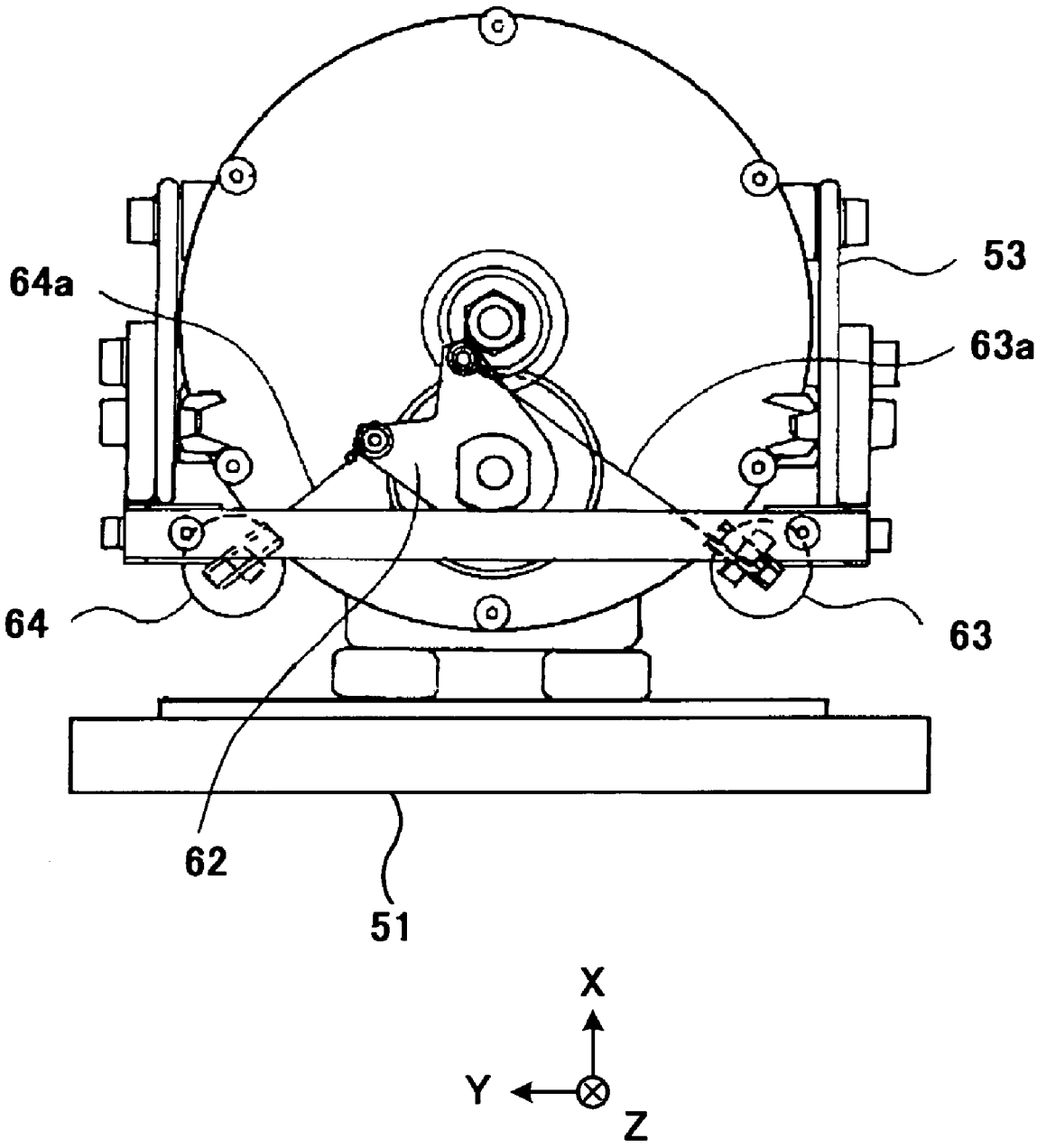
FIG. 21 is a view illustrating the left side of FIG. 20.
Figure 22:
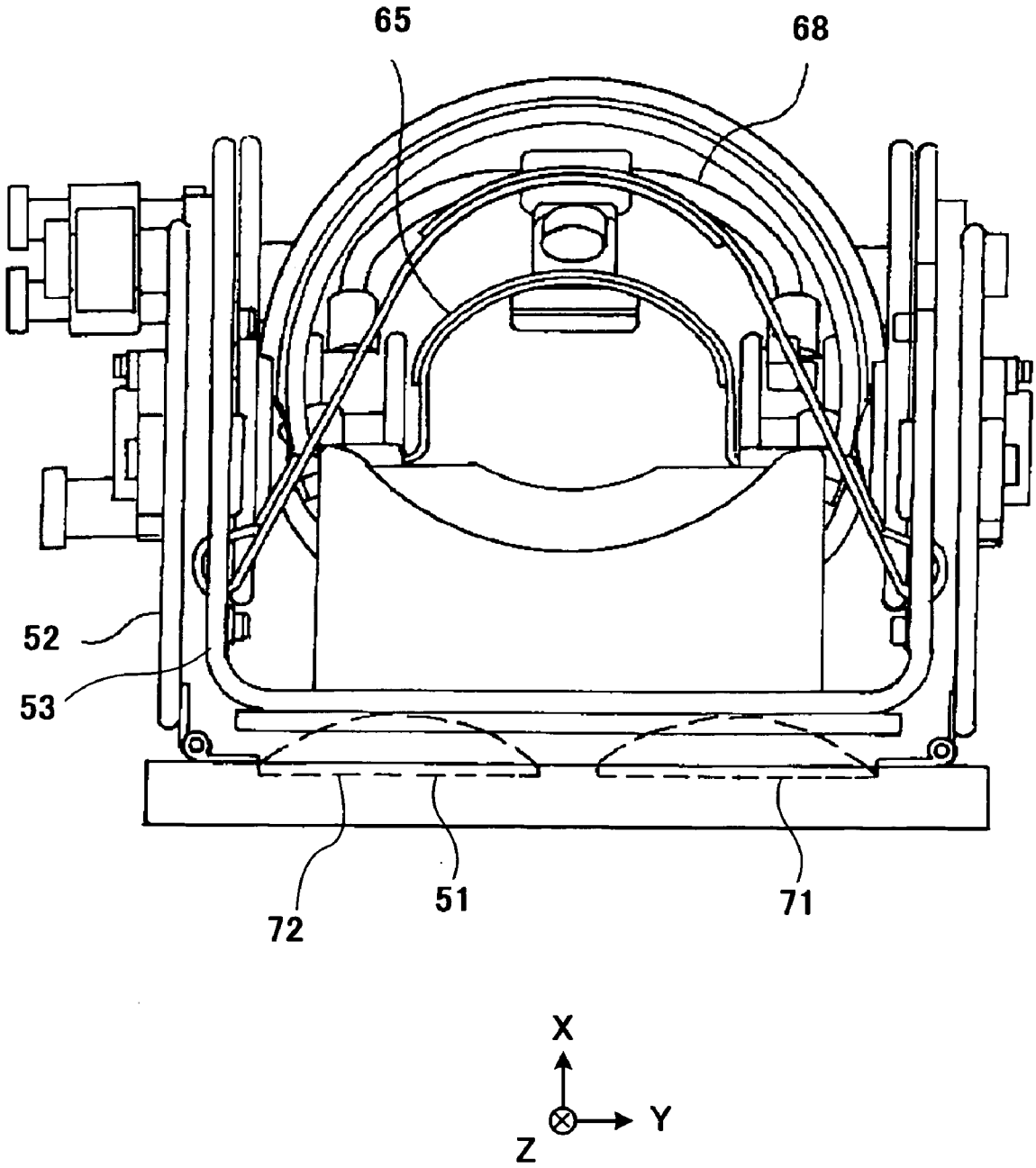
FIG. 22 is a view illustrating the right side of FIG. 20.

Next, described below is the CPM device according to a fourth embodiment of the present invention. FIG. 19 is a side view thereof, FIG. 20 is a plan view of FIG. 19, FIG. 21 is a view of the left side of FIG. 19, and FIG. 22 is a view of the right side of FIG. 19. In the drawings, a rotary support portion 52 is provided at an end portion on a base plate 51. A forearm support plate 53 which is a turning member supporting the forearm is rotatably coupled to the rotary support member 52 so as to be turned about a horizontal rotary shaft 54 between a horizontal state (see FIG. 19) and a state (not shown) turned by 120° from the horizontal state.

Between the rotary support member 52 and the forearm support plate 53, there are provided a tubular actuator 55 for bending and a tubular air actuator 56 for stretching. These tubular air actuators 55 and 56 are simply drawn by straight lines but have the same structure as that of the above-mentioned embodiment. The ends on one side of the tubular air actuators 55 and 56 are rotatably connected to the shafts 57 and 58 attached to the forearm support plate 53, and the ends on the other side thereof are rotatably connected to the shafts 59 and 60 attached to the rotary support portion 52.

Here, a positional relationship is described below between the attachment of the tubular actuators 55, 56 and the rotary shaft 54 of the forearm support plate 53. A straight line connecting the center axes of the shafts 57 and 59 mounting the tubular air actuator 55 has an angle of nearly 60° relative to the straight line that connects the center axes of the shafts 54 and 59. On the other hand, a straight line connecting the center axes of the shafts 58 and the shaft 60 mounting the tubular air actuator 56 and a straight line connecting the center axes of the shafts 54 and 60, are defining an obtuse angle which is smaller than 180°. In other words, the shaft 60 is mounted at a position on the left side of the straight line that connects the center axes of the shaft 54 and the shaft 59 in the drawing and on the side closer to the base plate 51 relative to the center axis of the shaft 54.

By arranging the tubular air actuators 55 and 56 as described above, the forearm support plate 53 can be reciprocally turned without converting a decrease in the length of the tubular air actuator into the turn of the pulley. The principle of operation is as described below. When the air is fed to the tubular air actuator 55, the contracting force that generates when the length of the tubular air actuator 55 contracts, acts as a turning force (torque) for turning the forearm support plate 53 about the shaft 54 clockwise. The torque acts until the shafts 54, 59 and 57 are brought into alignment on a straight line, i.e., until the forearm support plate 53 turns by about 120° from the horizontal state. No torque acts when the shafts 54, 59 and 57 are brought into alignment on the straight line, and the forearm support plate 53 ceases to turn. When the forearm support plate 53 ceases to turn, the air is discharged from the tubular air actuator 55 while the air is fed to the tubular air actuator 56. Then, the length of the tubular air actuator 56 contracts, and the contracting force that is generated acts as a torque for turning the forearm support plate 53 about the shaft 54 counterclockwise. Therefore, the forearm support plate 53 is returned back in the horizontal direction.

The elbow bending/stretching motion is effected by the above reciprocal turning operation of the forearm support plate 53.

The forearm support plate 53 is provided with an inward turn/outward turn plate 61 that turns about an axis in parallel with the Z-axis of FIG. 20. The inward turn/outward turn plate 61 turns integrally with a rolling mechanical portion 62 provided at an end of the forearm support plate 53. On the forearm support plate 53, there are mounted a pair of tubular air actuators 63, 64 with wire for turning the inward turn/outward turn plate 61.

The tubular air actuators 63, 64 with wire are the same as the tubular air actuators described in connection with the specified invention, and have wires 63*a*, 64*a* connected to the ends thereof for transmitting the driving force. The rolling mechanical portion 62 is turned by the expansion and contraction of the air actuator portions of the tubular air actuators 63 and 64 with wire, and the inward turn/outward turn plate 61 turns (swings) relative to the forearm support plate 53. Thus, the forearm can be turned inward and outward.

On the inward turn/outward turn plate 61, there are provided a wrist holder 65 for loosely holding the wrist of the user and a mounting belt 66 to be mounted on the hand of the user. The mounting belt 66 is connected to a wrist drive mechanism 68 that can be turned about a shaft 67 in parallel with the Y-axis in the drawing. A pair of tubular air actuators 69 and 70 are provided between the wrist drive mechanism 68 and the inward turn/outward turn plate 61 to turn the wrist drive mechanism 68. The wrist drive mechanism 68 turns (swings) upon alternately feeding the air to, and discharging the air from, the tubular air actuators 69 and 70.

Between the base plate 51 and the forearm support plate 53, there are arranged first and second pad-shaped air actuators 71 and 72 as shown in FIG. 22, being arranged along the direction of Y-axis. The operations of the pad-shaped air actuators 71 and 72 are the same as those of the CPM device of the third embodiment. By selectively feeding the air to either the first pad-shaped actuator 71 or the second pad-shaped air actuator 72, the shoulder/scapular arch can be bent and stretched. Further, by simultaneously feeding the air to, and discharging the air from, the two pad-shaped air actuators 71 and 72, the shoulder can be moved up and down.

In the CPM device of this embodiment, too, the tubular air actuators 55, 56, 63, 64, 69, 70 and the pad-shaped air actuators 71, 72 are used as drive sources, making it possible to decrease the size and weight as a whole. Besides, combinations of complex motions of a plurality of joints can be easily realized.

Though the above first to fourth embodiments have dealt with the CPM devices for effecting the rehabilitation of upper limbs inclusive of the shoulders, it should be noted that the invention can be further applied to the CPM devices for effecting the rehabilitation of lower limbs inclusive of the waist.

Further, though the above embodiments have used the air as the fluid, there can be further used any other fluid, such as a gas, an oil, water or the like.

As described above, the CPM device of the present invention turns the turning member by using a fluid pressure actuator which comprises an expanding/contracting member that expands and contracts as the fluid is fed and discharged, a mesh-like covering member covering the outer periphery of the expanding/contracting member, and a low friction member inserted between the expanding/contracting member and the mesh-like covering member, the fluid pressure actuator generating a driving force as the expanding/contracting member is expanded and the length thereof is contracted. Therefore, the size and weight can be decreased as a whole. Further, the fluid pressure actuator has the low friction member arranged between the expanding/contracting member and the mesh-like covering member, and features a long life. Therefore, the user can use the CPM device for extended periods of time without fear of failure.

Further, since the air pressure actuators are used as the actuator for turning the turning member relative to the base and as a plurality of actuators for turning the moving member relative to the turning member, the size and weight can be decreased as a whole, and combinations of motions of a plurality of joints can be easily realized.

The invention claimed is:

1. A fluid pressure actuator comprising an inner tube that expands and contracts as the fluid is fed and discharged, a mesh sleeve covering the outer periphery of said inner tube and of which the diameter expands and of which the length contracts as said inner tube expands, and a low friction member obtained by so knitting fine fibers as to possess expanding and contracting properties between said inner tube and said mesh sleeve, said low friction member being so arranged as to cover said inner tube and being a cylindrical body obtained by knitting in a circumferential direction without a seam.

2. A fluid pressure actuator according to claim 1, wherein said low friction member has a coefficient of friction for said mesh sleeve which is smaller than a coefficient of friction thereof for said inner tube.

3. A fluid pressure actuator according to claim 1, wherein said low friction member is obtained by knitting a synthetic fiber of a combination of a polyurethane core fiber and a nylon fiber so as to exhibit expanding/contracting property.

4. A fluid pressure actuator according to claim 3, wherein said synthetic fiber has a thickness of about 40 deniers.

5. A fluid pressure actuator according to claim 1, wherein said low friction member of the cylindrical body knitted in said circumferential direction without the seam, when contracted, has a diameter nearly equal to the diameter of the inner tube.

6. A fluid pressure actuator according to claim 1, wherein said inner tube is formed having a noncircular shape in cross section maintaining the same surface area yet increasing the sectional area that is surrounded thereby in at least part of a step of shifting from the contracted state to the expanded state.

7. A fluid pressure actuator according to claim 6, wherein the inner tube having said noncircular shape in cross section has a plurality of ridge-like portions that protrude inward in cross section when it is being contracted, and the ridge-like portions are expanded when the fluid is fed into the inner tube to expand the diameter of the inner tube.

8. A fluid pressure actuator according to claim 1, wherein the mesh sleeve has a fine mesh structure which prevents the inner tube from partly swelling through the fine mesh structure of the mesh sleeve when the inner tube expands, the fine mesh structure being formed of a plurality of filaments.

9. A fluid pressure actuator according to claim 8, wherein the fine mesh structure is formed of three filaments.

10. A fluid pressure actuator according to claim 8, wherein the fine mesh structure is formed of 288 polyethylene filaments.

11. A CPM device comprising a base member, a turning member coupled to the base member so as to be turned and is turned relative to said base member to effect the joint motion of the human body that is mounted or supported, and a first joint motion mechanism including an actuator for feeding the power to said turning member, wherein said actuator is a fluid pressure actuator comprising an inner tube that expands and contracts as the fluid is fed and discharged, a mesh sleeve covering the outer periphery of said inner tube and of which the diameter expands and of which the length contracts as said inner tube expands, and a low friction member obtained by so knitting fine fibers as to possess expanding/contracting properties between said inner tube and said mesh sleeve, said low friction member being so arranged as to cover said inner tube, and being a cylindrical body obtained by knitting the fine fibers in a circumferential direction without a seam.

12. A CPM device according to claim 11, wherein said low friction member is obtained by knitting a synthetic fiber of a combination of a polyurethane core fiber and a nylon fiber so as to exhibit expanding/contracting property.

13. A CPM device according to claim 11, wherein said fluid pressure actuators are provided in a plural number to reciprocally move said turning member within a predetermined angular range relative to said base member, and the air is fed to, or discharged from, the fluid pressure actuators depending upon the direction of turn of said turning member.

14. A CPM device according to claim 11, wherein said turning member is provided with an additional joint motion mechanism which effects a simple or a composite joint motion to a portion moved by said turning member and to a portion beyond thereof.

15. A CPM device according to claim 14, wherein said additional joint motion mechanism is a second joint motion mechanism that is provided on said turning member, and effects the joint motion between the portion moved by said turning member and the portion beyond thereof.

16. A CPM device according to claim 14, wherein said additional joint motion mechanism is a third joint motion mechanism for turning the portion moved by said turning member and the portion beyond thereof inward and outward simultaneously.

17. A CPM device according to claim 14, wherein said additional joint motion mechanism is a fourth joint motion mechanism provided between said base member and said turning member to effect the joint motion for the root portion of the portion supported by said turning member.

18. A CPM device according to claim 14, wherein said additional joint motion mechanism includes, being provided on said turning member, two or more joint motion mechanisms out of a second joint motion mechanism that effects the joint motion between the portion moved by said turning member and the portion beyond thereof, a third joint motion mechanism for turning the portion moved by said turning member and the portion beyond thereof inward and outward simultaneously, and a fourth joint motion mechanism provided between said base member and said turning member to effect the joint motion for the root portion of the portion supported by said turning member.

19. A CPM device according to claim 11, wherein said low friction member has a coefficient of friction which is smaller to the mesh sleeve than to the inner tube.

20. A fluid pressure actuator comprising:

an inner tube that expands and contracts as fluid is fed and discharged, a mesh sleeve covering the outer periphery of said inner tube and having a diameter which expands and a length which contracts as the inner tube expands;

wherein the mesh sleeve has a fine mesh structure which prevents the inner tube from partly swelling through the fine mesh structure of the mesh sleeve when the inner tube expands.

21. A fluid pressure actuator according to claim 20, wherein the mesh structure is formed of a plurality of filaments.

22. A fluid pressure actuator according to claim 20, wherein the mesh structure is formed of three filaments.

23. A fluid pressure actuator according to claim 20, wherein the mesh structure is formed of 288 polyethylene filaments.

* * * * *